US011830649B2

(12) United States Patent
Yen et al.

(10) Patent No.: US 11,830,649 B2
(45) Date of Patent: Nov. 28, 2023

(54) DOUBLE 8-SHAPED INDUCTIVE DEVICE

(71) Applicant: Realtek Semiconductor Corporation, Hsinchu (TW)

(72) Inventors: Hsiao-Tsung Yen, Hsinchu (TW); Ka-Un Chan, Zhubei (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 882 days.

(21) Appl. No.: 16/680,687

(22) Filed: Nov. 12, 2019

(65) Prior Publication Data

US 2020/0335251 A1 Oct. 22, 2020

(30) Foreign Application Priority Data

Apr. 22, 2019 (TW) ..... 108114030

(51) Int. Cl.

| | |
|---|---|
| ***H01F 27/28*** | (2006.01) |
| ***H01F 27/00*** | (2006.01) |
| ***H01F 27/34*** | (2006.01) |
| ***H01F 27/29*** | (2006.01) |

(52) U.S. Cl.

CPC ..... *H01F 27/006* (2013.01); *H01F 27/29* (2013.01); *H01F 27/34* (2013.01)

(58) Field of Classification Search

CPC .. H01F 27/2804; H01F 27/323; H01F 41/041; H01F 41/122; H01F 2027/2809; H01F 27/292; H01F 2017/048; H01F 41/046; H01F 17/0013; H01F 27/28; H01F 27/324; H01F 41/042; H01F 41/125; H01F 2017/002

USPC ..... 336/192, 232, 198, 200

See application file for complete search history.

(56) References Cited

U.S. PATENT DOCUMENTS

| | | | | |
|---|---|---|---|---|
| 9,312,060 | B2 | 4/2016 | Godoy et al. | |
| 10,153,078 | B2 | 12/2018 | Yen et al. | |
| 2014/0077919 | A1* | 3/2014 | Godoy | H01F 27/006 336/226 |
| 2017/0012601 | A1* | 1/2017 | Yen | H03H 7/42 |

(Continued)

FOREIGN PATENT DOCUMENTS

| | | | |
|---|---|---|---|
| CN | 104769687 | A | 7/2015 |
| TW | 201428783 | A | 7/2014 |

(Continued)

OTHER PUBLICATIONS

China Patent Office, the office action of the corresponding Chinese application No. 201910356159.X dated May 27, 2021.

*Primary Examiner* — Shawki S Ismail
*Assistant Examiner* — Kazi S Hossain
(74) *Attorney, Agent, or Firm* — Locke Lord LLP; Tim Tingkang Xia, Esq.

(57) ABSTRACT

A double 8-shaped inductive device includes a first 8-shaped coil, a second 8-shaped coil, and a connection structure. The first 8-shaped coil includes a first connecting terminal. The second 8-shaped coil includes a second connecting terminal, which the first 8-shaped coil and the second 8-shaped coil are to be disposed side by side on two sides of a first imaginary line. The connection structure electrically couples to the first connecting terminal and the second connecting terminal, such that the first 8-shaped coil and the second 8-shaped coil form a connected circuit, and the first 8-shaped coil and the second 8-shaped coil include a loop respectively.

18 Claims, 8 Drawing Sheets

(56) References Cited

U.S. PATENT DOCUMENTS

| | | | | |
|---|---|---|---|---|
| 2017/0200547 | A1* | 7/2017 | Yen | H01F 27/29 |
| 2018/0040412 | A1* | 2/2018 | Yen | H01F 17/0006 |
| 2019/0221350 | A1 | 7/2019 | Yen et al. | |
| 2019/0279809 | A1 | 9/2019 | Yen | |

FOREIGN PATENT DOCUMENTS

| | | | |
|---|---|---|---|
| TW | I591800 | B | 7/2017 |
| TW | 201806205 | A | 2/2018 |
| TW | I643217 | B | 12/2018 |
| TW | I645426 | B | 12/2018 |

* cited by examiner

DOUBLE 8-SHAPED INDUCTIVE DEVICE

CROSS-REFERENCE TO RELATED APPLICATION

This application claims priority to and the benefit of Taiwan Application Serial Number 108114030, filed on Apr. 22, 2019, the entire content of which is incorporated herein by reference as if fully set forth below in its entirety and for all applicable purposes.

BACKGROUND

Technical Field

The disclosure generally relates to inductive devices, and more particularly, to 8-shaped inductive devices.

Description of Related Art

In general, the efficiency of the 8-shaped inductive devices is influenced by the asymmetric structure of the device. Specifically, if the two coils of a single 8-shaped inductive device do not form a fully symmetric structure (for example, the top part and bottom part are not symmetric, and/or the left part and the right part are symmetric), magnetic field bias will occur at each coil because each magnetic direction of the inductive device is different. As a result, the unbalanced states will have influence over the magnetic cancellation in each magnetic direction.

Accordingly, there are still great problems in the inductive device, and an efficiency-promoted issue has become increasingly popular. For at least the problems addressed above, the person having ordinary skill in the art puts efforts into the addressed problems.

SUMMARY

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

One aspect directed towards a double 8-shaped inductive device is disclosed, which includes a first 8-shaped coil, a second 8-shaped coil, and a connection structure. The first 8-shaped coil includes a first connecting terminal; the second 8-shaped coil includes a second connecting terminal, and the first 8-shaped coil and the second 8-shaped coil are to be disposed side by side on two sides of a first imaginary line; the connection structure is configured to electrically coupled to the first connecting terminal and the second connecting terminal, such that the first 8-shaped coil and the second 8-shaped coil form a connected circuit, which the first 8-shaped coil and the second 8-shaped coil include a loop.

One aspect directed towards a double 8-shaped inductive device is disclosed, which includes a first 8-shaped coil, a second 8-shaped coil, and a connection structure. For example, the first 8-shaped coil includes a first connecting terminal; the second 8-shaped coil includes a second connecting terminal, and the first 8-shaped coil and the second 8-shaped coil are to be disposed side by side on two sides of a first imaginary line; the connection structure is configured to electrically coupled to the first connecting terminal and the second connecting terminal; and the first 8-shaped coil and the second 8-shaped coil includes a plurality of loops, which the first 8-shaped coil and the second 8-shaped coil form connected circuits based on the loops.

DETAILED DESCRIPTION

Figure 1:
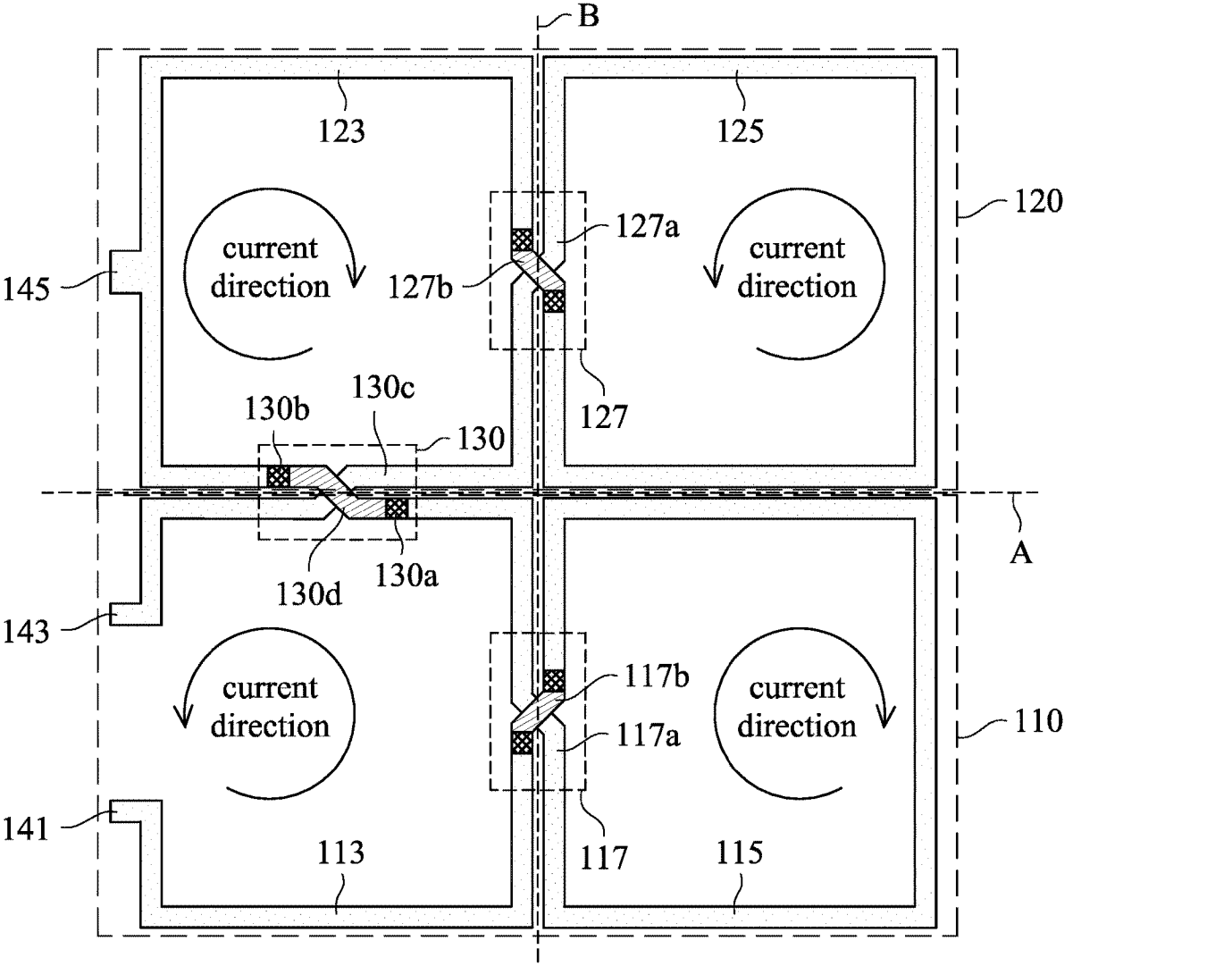
FIG. 1 is a schematic illustration of a double 8-shaped inductive device in accordance with some aspects of the present disclosure.

Reference will now be made in detail to the present embodiments of the disclosure, examples of which are illustrated in the accompanying drawings. Wherever possible, the same reference numbers are used in the drawings and the description to refer to the same or like parts.

Referring now to FIG. 1, as a schematic illustration of a double 8-shaped inductive device 100 in accordance with some aspects of the present disclosure. As shown in FIG. 1, the double 8-shaped inductive device 100 includes a first 8-shaped coil 110, a second 8-shaped coil 120, and a connection structure 130. The first 8-shaped coil 110 and the second 8-shaped coil 120 are to be disposed side by side on two sides of an imaginary line A. In some embodiments, the first 8-shaped coil 110 and the second 8-shaped coil 120 are the coils with the same size, such that the double 8-shaped inductive device 100 is approximately symmetrical in shape.

The connection structure 130 includes a first connection 130*c* and a second connection 130*d*. The first connection 130*c* is disposed at the first metal layer. The second connection 130*d* is disposed at the second metal layer, which the second metal layer is different from the first metal layer. The first connection 130*c* is connected with the first 8-shaped coil 110 and the second 8-shaped coil 120. In some embodiments, the first connection 130*c*, the first 8-shaped coil 110, and the second 8-shaped coil 120 are integrated structure.

The first 8-shaped coil 110 includes a first connecting terminal 130*a*. The second 8-shaped coil 120 includes a second connecting terminal 130*b*. The second connection 130*d* crosses over the first connection 130*c*. The second connection 130*d* is coupled to the first connecting terminal

130*a* of the first 8-shaped coil 110 and the second connecting terminal 130*b* of the second 8-shaped coil 120, such that the first 8-shaped coil 110 and the second 8-shaped coil 120 form a connected circuit.

The double 8-shaped inductive device 100 includes a first voltage I/O terminal 141, 143 and a second voltage I/O terminal 145. The first voltage I/O terminal 141, 143 and the second voltage I/O terminal 145 are, based on two sides of the imaginary line A, disposed at the first 8-shaped coil 110 and the second 8-shaped coil 120 respectively, such that the first voltage I/O terminal 141, 143 and the second voltage I/O terminal 145 are disposed at one of four sides of the double 8-shaped inductive device 100 (for example, the first voltage I/O terminal 141, 143 and the second voltage I/O terminal 145 are disposed at the left side of the double 8-shaped inductive device 100 in FIG. 1). In some embodiments, the first voltage I/O terminal 141, 143 are disposed at the first 8-shaped coil 110, and the second voltage I/O terminal 145 is disposed at the second 8-shaped coil 120.

In some embodiments, the first voltage I/O terminal 141 is coupled to a voltage input positive terminal (P port), the first voltage I/O terminal 143 is coupled to a voltage input negative terminal (N port), and second voltage I/O terminal 145 is coupled to center-tapped port.

As shown in FIG. 1, the first 8-shaped coil 110 includes a first spiral coil 113 and a second spiral coil 115. The first spiral coil 113 and the second spiral coil 115 are disposed to be side by side on two sides of an imaginary line B, and the imaginary line B is perpendicular to the imaginary line A. The first spiral coil 113 and the second spiral coil 115 are electrically coupled with each other through a first connection structure 117. In some embodiments, the first connection structure 117 includes a first connection 117*a* of the first metal layer and a second connection 117*b* of the second metal layer. The second connection 117*b* crosses over the first connection 117*a*. Accordingly, the first spiral coil 113 and the second spiral coil 115 form the 8-shaped circuit.

Similarly, the second 8-shaped coil 120 includes a third spiral coil 123 and a fourth spiral coil 125. The third spiral coil 123 and the fourth spiral coif 125 are to be disposed side by side on two sides of the imaginary line B. The third spiral coil 123 and the fourth spiral coil 125 are electrically coupled with each other through a connection structure 127. In some embodiments, the connection structure 127 includes a first connection 127*a* of the first metal layer and a second connection 127*b* of the second metal layer. The second connection 127*b* crosses over the first connection 127*a*. Accordingly, the third spiral coil 123 and the fourth spiral coil 125 form the 8-shaped circuit.

In some embodiments of the spiral coils, current directions of adjacent coils are reversed with each other. For example, when the current direction of the first spiral coil 113 is counterclockwise, the current direction of the second spiral coil 115 and the current direction of the third spiral coil 123 are clockwise, and the current direction of the fourth spiral coil 125 is counterclockwise, and vice versa.

In some embodiments, the double 8-shaped inductive device 100 includes a loop. The double 8-shaped inductive device 100 is approximately symmetric based on the imaginary line A, and the current direction of the first 8-shaped coil 110 is approximately symmetric to the current direction of the second 8-shaped coil 120 based on the imaginary line A.

Figure 2:
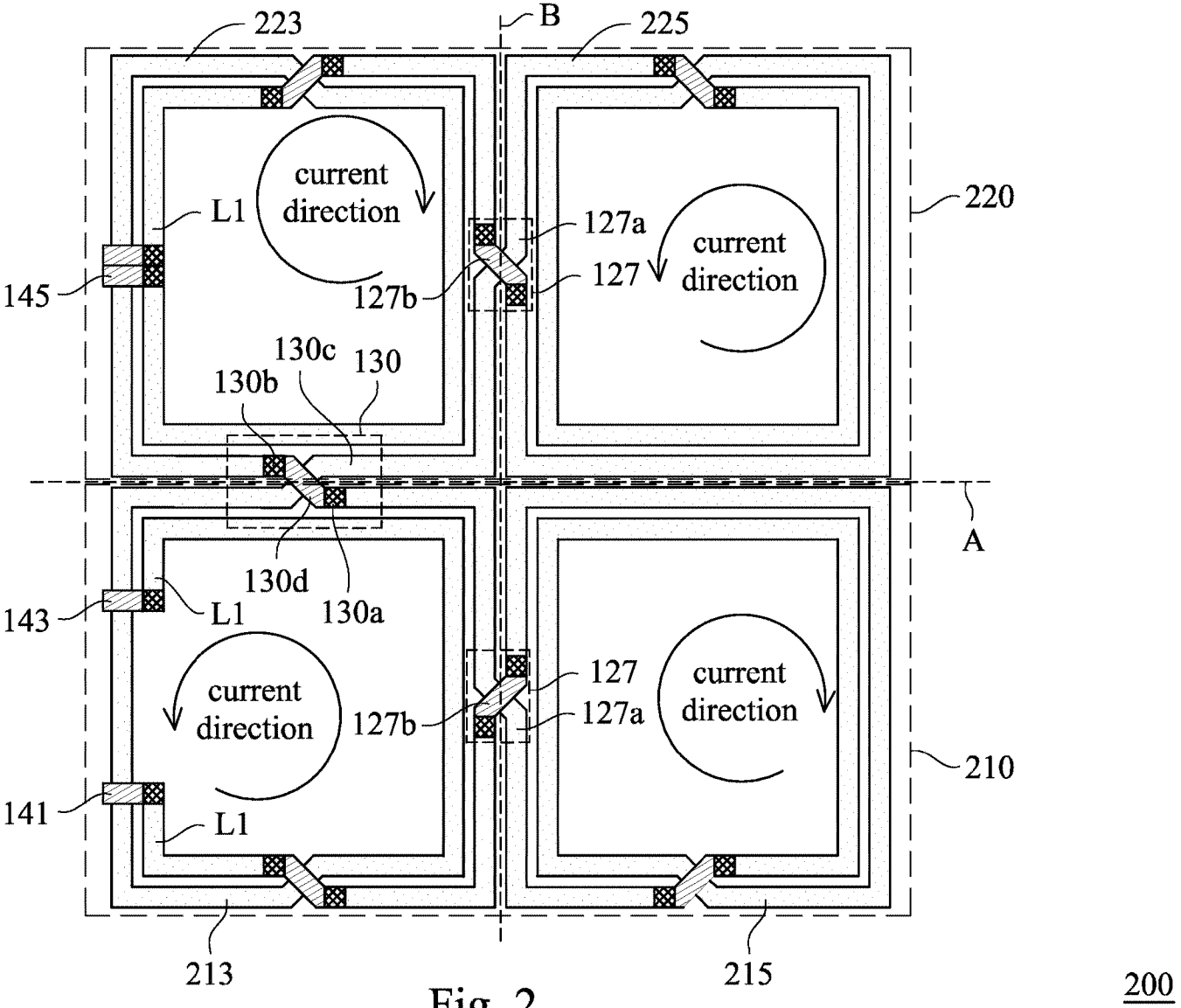
FIG. 2 is a schematic illustration of a double 8-shaped inductive device in accordance with some aspects of the present disclosure.

Referring now to FIG. 2, as a schematic illustration of a double 8-shaped inductive device 200 in accordance with some aspects of the present disclosure. Compared with FIG. 1, the double 8-shaped inductive device 200 in FIG. 2 has two loops. Hereinafter the same/similar notations/numbers are referred to the same/similar elements and the statements are not repeated again. The double 8-shaped inductive device 200 includes a first 8-shaped coil 210 and a second 8-shaped coil 220. The first 8-shaped coil 210 includes a first spiral coil 213 and a second spiral coil 215. The second 8-shaped coil 220 includes a third spiral coil 223 and a fourth spiral coil 225.

In the embodiments that the spiral coils have a plurality of loops, at least one of the first voltage I/O terminal 141, 143 and at least one of a second voltage I/O terminal 145 are disposed at an innermost loop or an outermost loop of the loops. For example, as shown in FIG. 2, the at least one of the first voltage I/O terminal 141, 143 and the at least one of the second voltage I/O terminal 145 are at the innermost loop L1 of the loops, and the innermost loop L1 crosses over the other outer loops in order to connect with other circuits.

Figure 3:
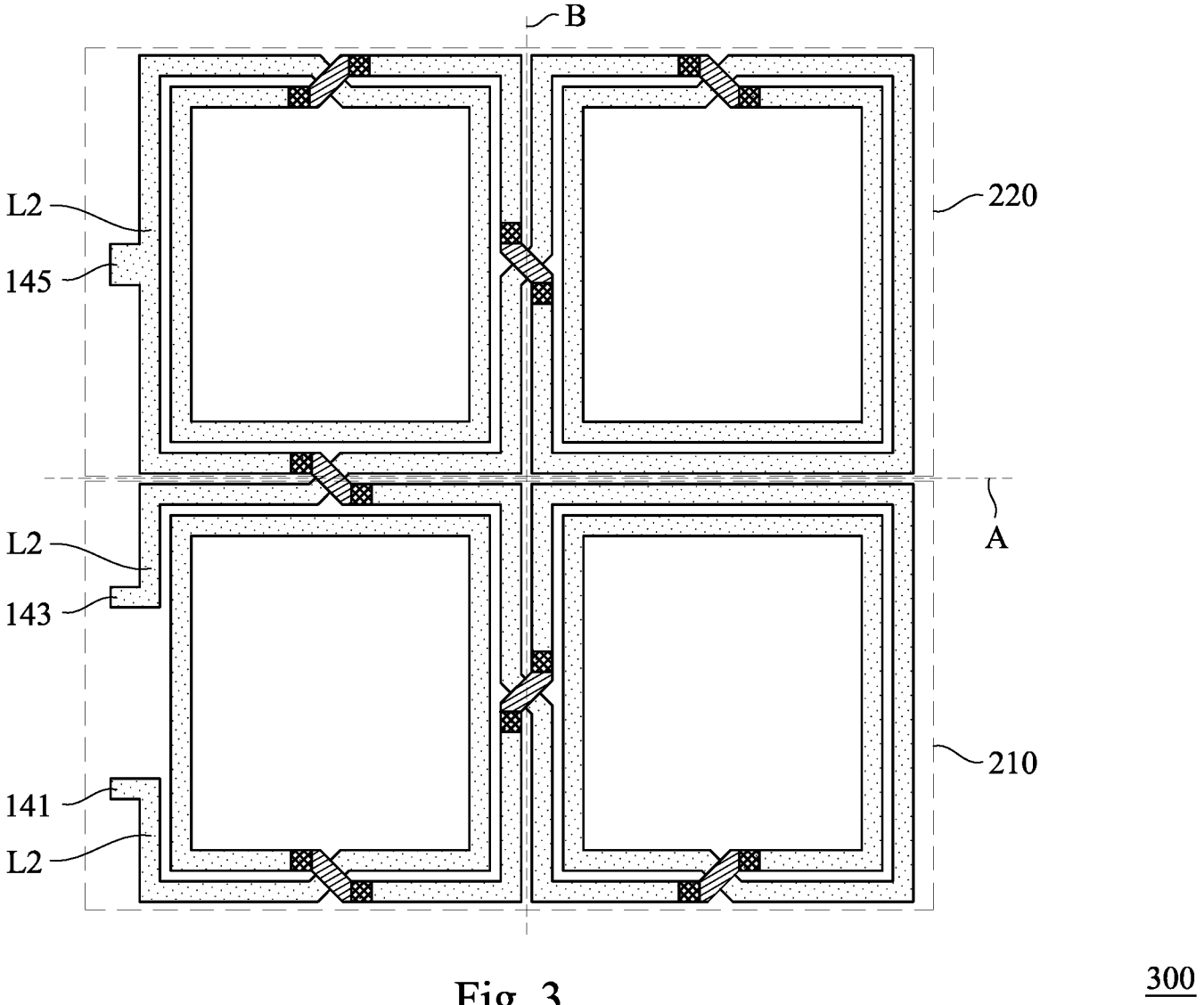
FIG. 3 is a schematic illustration of a double 8-shaped inductive device in accordance with some aspects of the present disclosure.

On the other hand, referring now to FIG. 3, as a schematic illustration of a double 8-shaped inductive device 300 in accordance with some aspects of the present disclosure. Compared with FIG. 2, the first voltage I/O terminal 141, 143 and the second voltage I/O terminal 145, in FIG. 3, are disposed at the outermost loop L2 of the loops.

Figure 4:
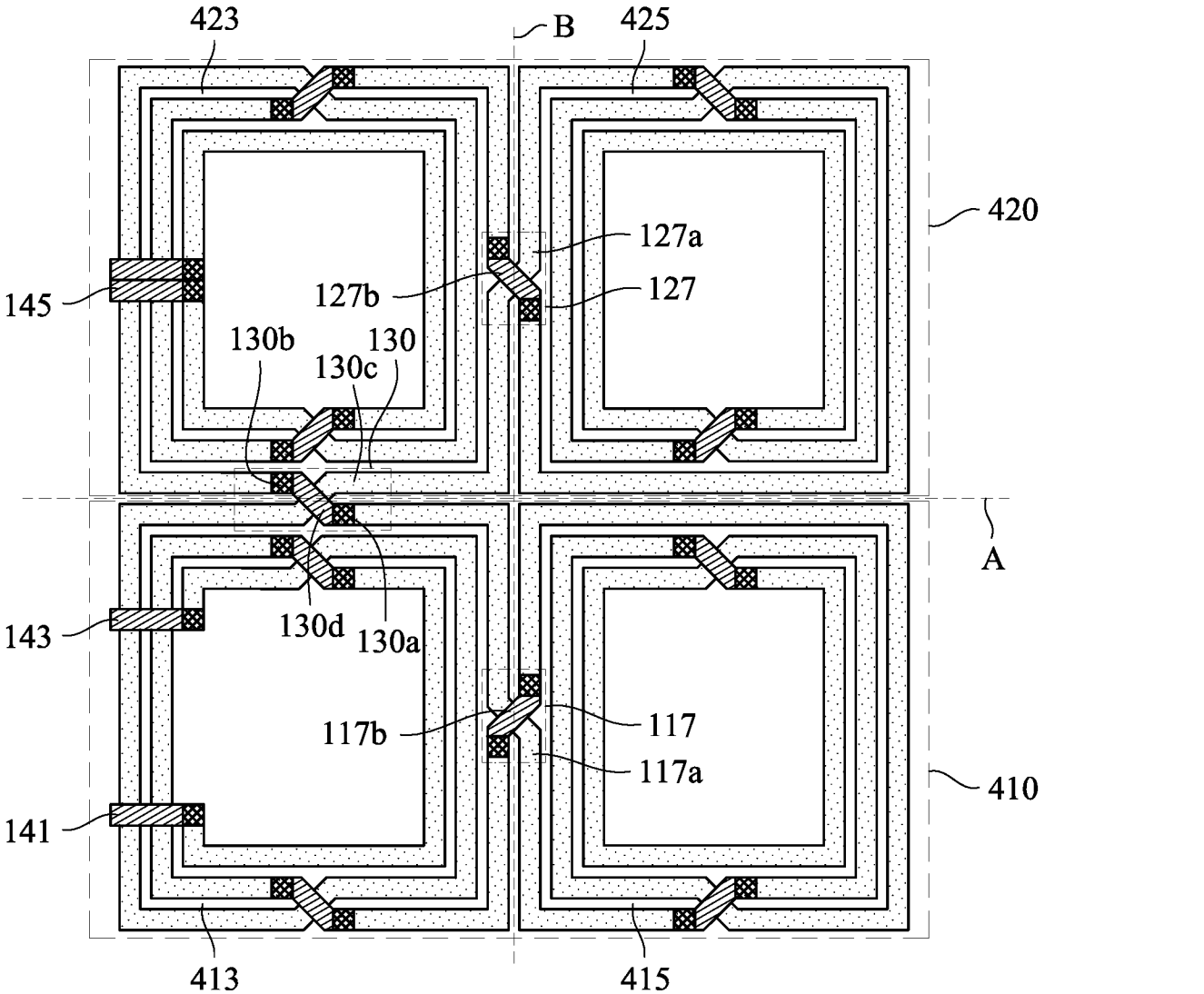
FIG. 4 is a schematic illustration of a double 8-shaped inductive device in accordance with some aspects of the present disclosure.

Referring now to FIG. 4, as a schematic illustration of a double 8-shaped inductive device 400 in accordance with some aspects of the present disclosure. Compared with the double 8-shaped inductive device 200, in FIG. 2, having two loops, the double 8-shaped inductive device 400 in FIG. 4 has three loops. The double 8-shaped inductive device 400 includes a first 8-shaped coil 410 and a second 8-shaped coil 420. The first 8-shaped coil 410 includes a first spiral coil 413 and a second spiral coil 415. The second 8-shaped coil 420 includes a third spiral coil 423 and a fourth spiral coil 425.

Figure 5:
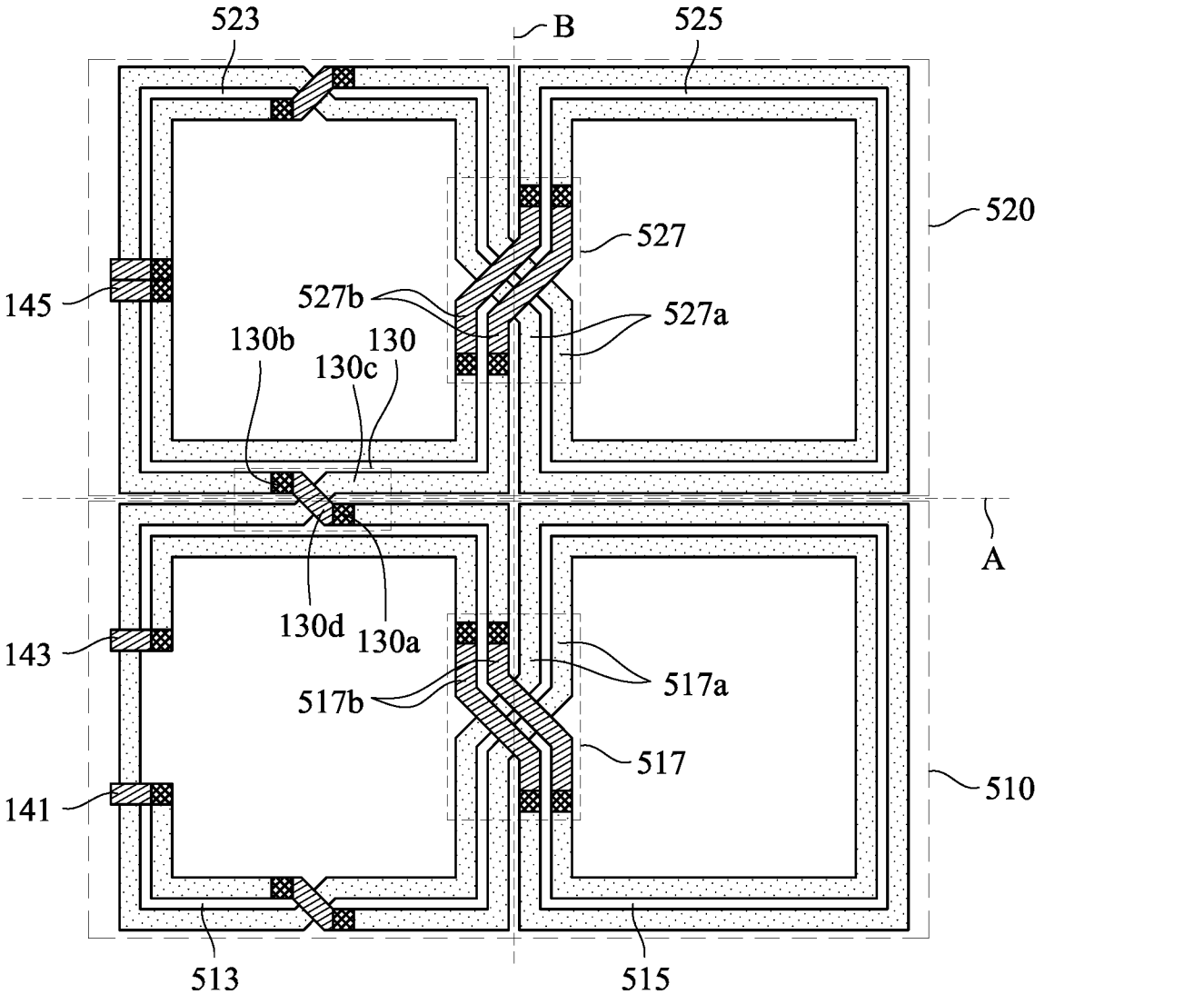
FIG. 5 is a schematic illustration of a double 8-shaped inductive device in accordance with some aspects of the present disclosure.

Referring now to FIG. 5, as a schematic illustration of a double 8-shaped inductive device 500 in accordance with some aspects of the present disclosure. The double 8-shaped inductive device 500 includes a first 8-shaped coil 510 and a second 8-shaped coil 520. The first 8-shaped coil 510 includes a first spiral coil 513 and a second spiral coil 515. The second 8-shaped coil 520 includes a third spiral coil 523 and a fourth spiral coil 525.

Compared with FIG. 2, the first spiral coil 513 and the second spiral coil 515 in FIG. 5 are electrically coupled with each other through the first connection structure 517. In some embodiments, the first connection structure 517 includes at least one of a first connection 517*a* of the first metal layer and at least one of a second connection 517*b* of the second metal layer. The at least one of the second connection 517*b* cross(es) the at least one of the first connection 517*a*.

Similarly, the third spiral coil 523 and the fourth spiral coil 525 are electrically coupled with each other through a second connection structure 527. In some embodiments, the second connection structure 527 includes at least one of a first connection 527*a* of the first metal layer and at least one of a second connection 527*b* of the second metal layer. The at least one of the second connection 527*b* cross(es) the at least one of the first connection 527*a*.

In some embodiments, the number of the first connection 517*a*, 527*a* is 1 or 2, and the number of the second connection 517*b*, 527*b* is 1 or 2.

Figure 6:
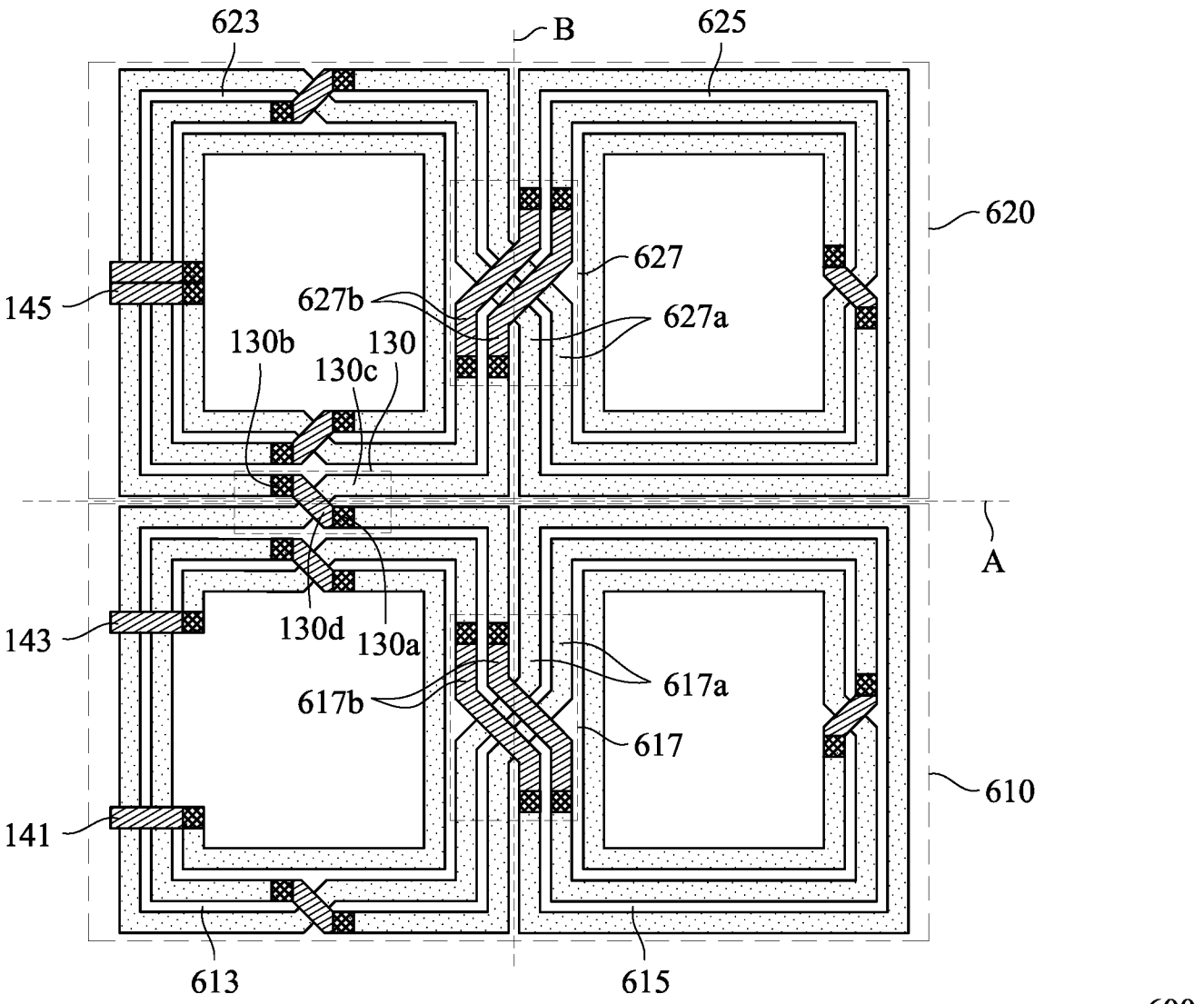
FIG. 6 is a schematic illustration of a double 8-shaped inductive device in accordance with some aspects of the present disclosure.

Referring now to FIG. 6, as a schematic illustration of a double 8-shaped inductive device 600 in accordance with some aspects of the present disclosure. Compared with FIG. 5, the double 8-shaped inductive device 600 in FIG. 6 has three loops. The double 8-shaped inductive device 600 includes a first 8-shaped coil 610 and a second 8-shaped coil 620. The first 8-shaped coil 610 includes a first spiral coil 613 and a second spiral coil 615. The second 8-shaped coil 620 includes a third spiral coil 623 and a fourth spiral coil 625. In FIG. 6, the first voltage I/O terminal 141, 143 and the second voltage I/O terminal 145 are disposed at the same side of four sides of the double 8-shaped inductive device 600, which may be disposed at the different 8-shaped coils of the double 8-shaped inductive device 600. For example, the first voltage I/O terminal 141, 143 and the second voltage I/O terminal 145 are disposed at the left side of the double 8-shaped inductive device 600 in FIG. 6, which the first voltage I/O terminal 141, 143 are disposed at the a first 8-shaped coil 610 and the second voltage I/O terminal 145 is disposed at the second 8-shaped coil 620.

Figure 7:
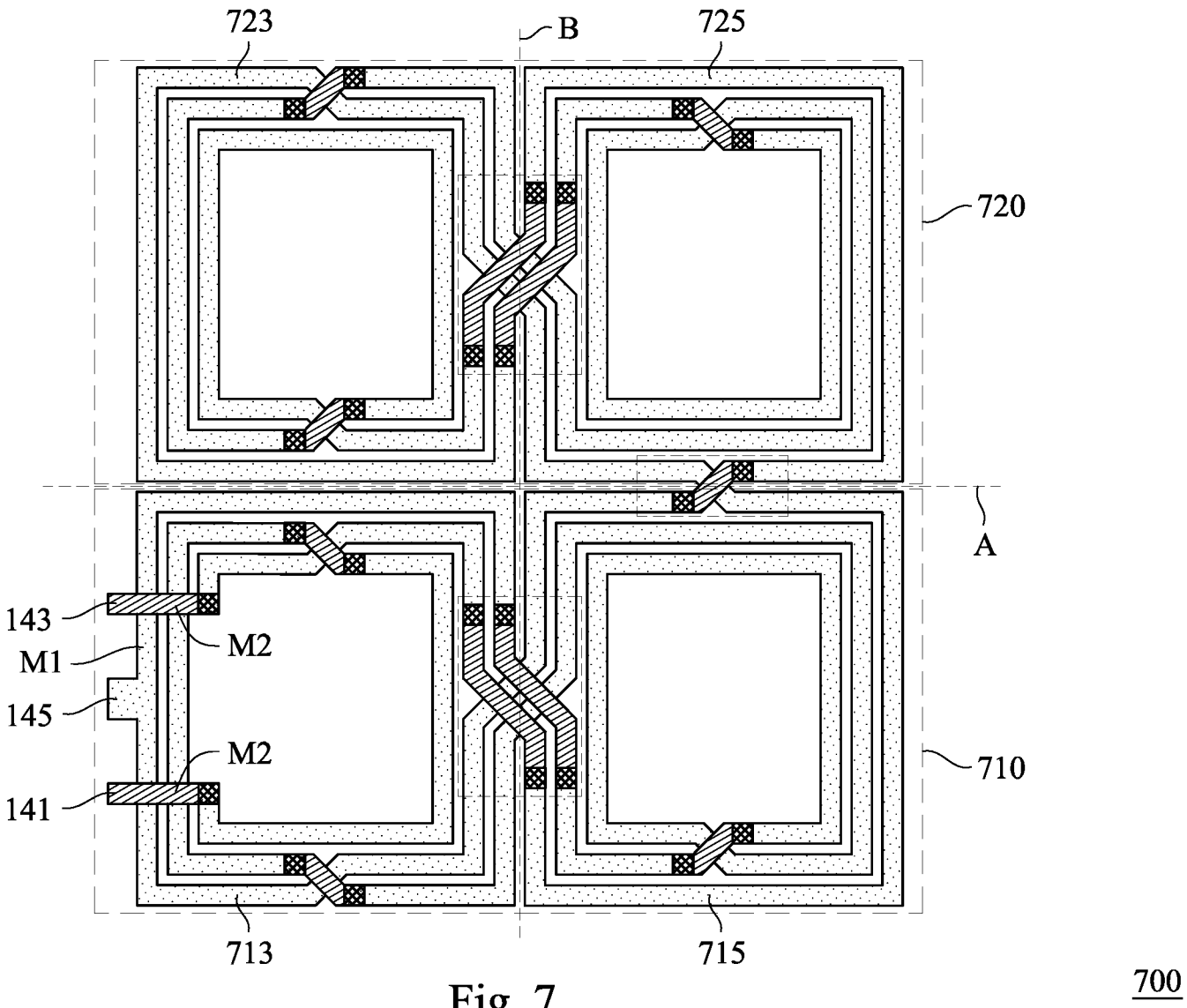
FIG. 7 is a schematic illustration of a double 8-shaped inductive device which has three loops in accordance with some aspects of the present disclosure.

Referring now to FIG. 7, as a schematic illustration of a double 8-shaped inductive device 700 which has three loops in accordance with some aspects of the present disclosure. The double 8-shaped inductive device 700 includes a first 8-shaped coil 710 and a second 8-shaped coil 720. The first 8-shaped coil 710 includes a first spiral coil 713 and a second spiral coil 715. The second 8-shaped coil 720 includes a third spiral coil 723 and a fourth spiral coil 725.

Compared with FIG. 6, the first voltage I/O terminal 141, 143 and the second voltage I/O terminal 145 in FIG. 7 are disposed to the same spiral coil. For example, the first voltage I/O terminal 141, 143 and the second voltage I/O terminal 145 are disposed at the first spiral coil 713. The first voltage I/O terminal 141, 143 and the second voltage I/O terminal 145 may be disposed at the same one spiral coil except the first spiral coil 713 according to other encircling patterns of the spiral coils, and the first voltage I/O terminal 141, 143 and the second voltage I/O terminal 145 are not limited to be disposed at the first spiral coil 713 in the present disclosure.

In FIG. 7, the first voltage I/O terminal 141, 143 is at the outermost loop of the first spiral coil 713 and at the first metal layer M1. The second voltage I/O terminal 145 is at the innermost loop of the first spiral coil 713 and at the second metal layer M2. The second voltage I/O terminal 145 crosses over other outer loops in order to connect with the voltage terminals.

Accordingly, the present disclosure provides devices, such as the double 8-shaped inductive devices 100~700, which the first voltage I/O terminal 141, 143 and the second voltage I/O terminal 145 may be flexibly disposed at.

Figure 8:
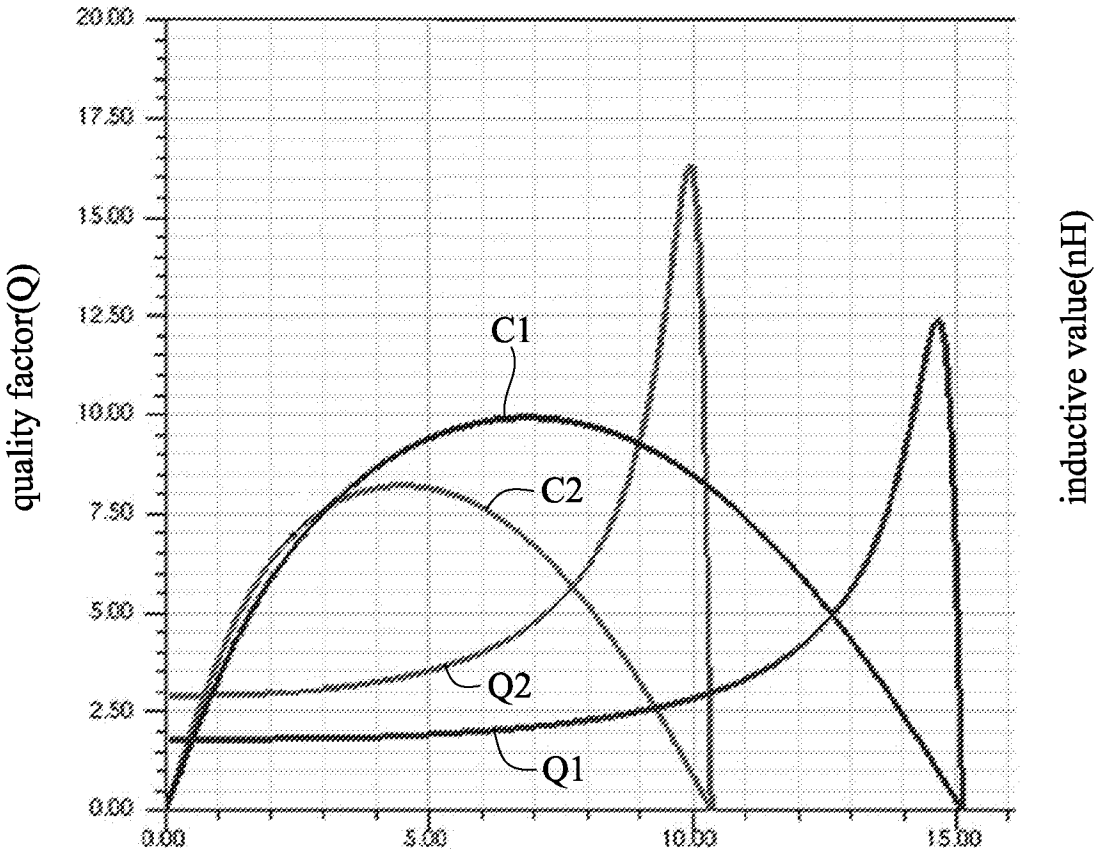
FIG. 8 is an experimental data illustration of double 8-shaped inductive device illustrated in FIG. 5 and FIG. 6 in accordance with some aspects of the present disclosure.

Referring now to FIG. 8, as an experimental data illustration of double 8-shaped inductive devices 500 and 600 illustrated in FIG. 5 and FIG. 6 in accordance with some aspects of the present disclosure. The experimental data illustrates that quality factors Q and inductive values of the double 8-shaped inductive device 500, 600 differ from different frequency. The curves C1, C2 are the quality factor curves of the double 8-shaped inductive devices which have two loops and three loops respectively. As shown in FIG. 8, when the double 8-shaped inductive devices which have two loops and three loops are operated at the frequencies, such as 5 GHz and 7 GHz, the quality factors are approximate to 10 and 8 respectively. Furthermore, the two inductive values (the curve Q1 and Q2) are approximate to each other. Accordingly, because of the configurations and structures of the double 8-shaped inductive devices provided in the present disclosure, the noises can be reduced and the inductive efficiencies can be increased.

Furthermore, the symmetrical structural configurations of the double 8-shaped inductive devices provided in the present disclosure can improve the induction coupling effects in four sides of the double 8-shaped inductive devices. Accordingly, not only the circuit operation effects can be enhanced, but also the designed circuit volumes can be smaller.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A double 8-shaped inductive device comprising:

a first 8-shaped coil comprising a first connecting terminal;

a second 8-shaped coil comprising a second connecting terminal, wherein the first 8-shaped coil and the second 8-shaped coil are to be disposed side by side on two sides of a first imaginary line;

a connection structure configured to electrically coupled to the first connecting terminal and the second connecting terminal, such that the first 8-shaped coil and the second 8-shaped coil form a connected circuit;

at least one of a first voltage input/output (I/O) terminal; and at least one of a second voltage I/O terminal, wherein the at least one of the first voltage I/O terminal and the at least one of the second voltage I/O terminal are, based on the first imaginary line, disposed at the first 8-shaped coil and the second 8-shaped coil respectively, and protruding from the first 8-shaped coil and from the second 8-shaped coil, respectively, and wherein the first 8-shaped coil and the second 8-shaped coil comprise a loop.

2. The double 8-shaped inductive device of claim 1, wherein a current direction of the first 8-shaped coil and a current direction of the second 8-shaped coil are symmetrical along the first imaginary line.

3. The double 8-shaped inductive device of claim 1, wherein the connection structure comprises a first connection of a first metal layer and a second connection of a second metal layer, wherein the second connection crosses over the first connection.

4. The double 8-shaped inductive device of claim 3, wherein the second connection couples to the first connecting terminal of the first 8-shaped coil and the second connecting terminal of the second 8-shaped coil.

5. A double 8-shaped inductive device comprising:

a first 8-shaped coil comprising a first connecting terminal;

a second 8-shaped coil comprising a second connecting terminal, wherein the first 8-shaped coil and the second 8-shaped coil are to be disposed side by side on two sides of a first imaginary line;

a connection structure configured to electrically coupled to the first connecting terminal and the second connecting terminal;

at least one of a first voltage input/output (I/O) terminal; and at least one of a second voltage I/O terminal, wherein the at least one of the first voltage I/O terminal and the at least one of the second voltage I/O terminal are, based on the first imaginary line, disposed at the first 8-shaped coil and the second 8-shaped coil respectively, and protruding from the first 8-shaped coil and from the second 8-shaped coil, respectively, and wherein the first 8-shaped coil and the second 8-shaped coil comprise a plurality of loops, and the first 8-shaped coil and the second 8-shaped coil form connected circuits based on the loops.

6. The double 8-shaped inductive device of claim 5, wherein the first 8-shaped coil further comprises a first spiral coil and a second spiral coil, and the first spiral coil and the second spiral coil are coupled with each other through a first connection structure, wherein the first connecting terminal is disposed at the first spiral coil.

7. The double 8-shaped inductive device of claim 5, wherein the second 8-shaped coil further comprises a third spiral coil and a fourth spiral coil, and the third spiral coil and the fourth spiral coil are coupled with each other through a second connection structure, wherein the second connecting terminal is disposed at the third spiral coil.

8. The double 8-shaped inductive device of claim 6, wherein the first spiral coil and the second spiral coil are to be disposed side by side on two sides of a second imaginary line, and the first imaginary line is perpendicular to the second imaginary line.

9. The double 8-shaped inductive device of claim 7, wherein the third spiral coil and the fourth spiral coil are to be disposed side by side on two sides of a second imaginary line, and the first imaginary line is perpendicular to the second imaginary line.

10. The double 8-shaped inductive device of claim 6, wherein a current direction of the first spiral coil is reversed with a current direction of the second spiral coil.

11. The double 8-shaped inductive device of claim 7, wherein a current direction of the third spiral coil is reversed to a current direction of the fourth spiral coil.

12. The double 8-shaped inductive device of claim 5, wherein the first 8-shaped coil further comprises a first spiral coil and a second spiral coil, and the first spiral coil and the second spiral coil are coupled with each other through a first connection structure, wherein the second 8-shaped coil further comprises a third spiral coil and a fourth spiral coil, and the third spiral coil and the fourth spiral coil are coupled with each other through a second connection structure, wherein a current direction of the first spiral coil is revered with a current direction of the third spiral coil, and a current direction of the second spiral coil is revered with a current direction of the fourth spiral coil.

13. The double 8-shaped inductive device of claim 5, wherein the at least one of the first voltage I/O terminal and the at least one of the second voltage I/O terminal are coupled to an innermost loop of the plurality of loops.

14. The double 8-shaped inductive device of claim 5, wherein the at least one of the first voltage I/O terminal and the at least one of the second voltage I/O terminal are coupled to an outermost loop of the plurality of loops.

15. The double 8-shaped inductive device of claim 5, wherein the connection structure comprises a first connection of a first metal layer and a second connection of a second metal layer, and the second connection crosses over the first connection.

16. The double 8-shaped inductive device of claim 15, wherein the second connection is coupled to the first connecting terminal of the first 8-shaped coil and the second connecting terminal of the second 8-shaped coil.

17. The double 8-shaped inductive device of claim 6, wherein the first connection structure comprises at least one of a first connection of a first metal layer and at least one of a second connection of a second metal layer, wherein the at least one of the second connection crosses over the at least one of the first connection.

18. The double 8-shaped inductive device of claim 7, wherein the second connection structure comprises at least one of a first connection of a first metal layer and at least one of a second connection of a second metal layer, and the at least one of the second connection crosses over the at least one of the first connection.

* * * * *